United States Patent [19]

Widen et al.

[11] 4,011,961

[45] Mar. 15, 1977

[54] PLASTIC CONTAINER AND BREAKABLE SEALING UNIT ULTRASONICALLY WELDED THERETO

[75] Inventors: Paul Oskar Birger Widen; Kurt Arne Emil Jansson; Anders Tore Kers, all of Uppsala, Sweden

[73] Assignee: Pharmcia Aktiebolag, Uppsala, Sweden

[22] Filed: Sept. 3, 1975

[21] Appl. No.: 609,959

[30] Foreign Application Priority Data

Sept. 6, 1974 Sweden ..... 7411316

[52] U.S. Cl. ..... 215/232; 215/249; 215/253

[51] Int. Cl.[2] ..... B65D 41/50

[58] Field of Search ..... 215/232, 32, 247, 248, 215/249, 250, 251, 252, 253, 257, DIG. 3; 220/266, 276, 359; 156/69, 73.1; 150/8

[56] References Cited

UNITED STATES PATENTS

| | | | |
|---|---|---|---|
| 2,930,063 | 3/1960 | Stull | 215/253 X |
| 3,204,835 | 9/1965 | Michel | 215/32 UX |
| 3,325,031 | 6/1967 | Singier | 215/247 |
| 3,561,668 | 2/1971 | Bergstrom | 215/232 X |
| 3,905,368 | 9/1975 | Lewis | 128/272 |
| 3,923,182 | 12/1975 | Choksi | 215/250 |

FOREIGN PATENTS OR APPLICATIONS

| | | | |
|---|---|---|---|
| 1,223,397 | 2/1971 | United Kingdom | 215/232 |

*Primary Examiner*—Donald F. Norton
*Attorney, Agent, or Firm*—Spencer & Kaye

[57] ABSTRACT

The neck opening of a filled plastic bottle is sealed by a sealing unit ultrasonically welded to the top of the neck. The sealing unit can be a one-piece member having an upwardly projecting hollow portion arranged to be broken off to provide an opening for dispensing the contents of the bottle. Alternatively, the sealing unit can be composed of an inner cap, an outer cap and a sealing disc interposed between the caps, this unit being arranged to be pierced by a cannula for withdrawing the contents of the bottle.

7 Claims, 9 Drawing Figures

PLASTIC CONTAINER AND BREAKABLE SEALING UNIT ULTRASONICALLY WELDED THERETO

BACKGROUND OF THE INVENTION

The present invention relates generally to packaging technique, and the invention relates in particular to a novel and unique sealing method as well as a seal or closure for containers, especially plastic bottles.

Several different types of containers are already known and many of them have various drawbacks. Glass bottles for instance have among other things the drawbacks of being easily crushed, and exhibiting relatively large weight as well as relatively high material cost. Containers manufactured of paper, for instance those provided with waxed or plastic coated surfaces, have the drawbacks among other things that they are easily deformable, they are easy to damage and they are incapable of being treated in connection with certain processes, for instance sterilization of the contents thereof. Then there are plastic bottles, and the invention relates to this type of container. Among the advantages of plastic bottles, their low weight, capability to withstand crushing and relatively low manufacturing cost could be mentioned. A drawback of plastic containers is their heat sensitiveness due to the inherent characteristics of the plastic material, and due to this fact, for instance deforming may occur in connection with heating and subsequent cooling. Another problem is faced in connection with obtaining a suitable seal or closure. Plastic bottles have often been sealed by a plastic cap being slightly depressable into the throat of the plastic bottle and then being maintained in place by a press fitting and the frictional engagement. Such seal requires an outer cover, generally made of a metallic strip, provided on top of the plastic cap and the upper portion of the bottle throat. Previously used sealing methods and closures manufactured have been relatively expensive and time demanding, and some other drawbacks have also been encountered. It has for instance not always been possible to guarantee with certainty that a leakage will not occur and that air, germs or the like would reach the contents of the bottle and contaminate the same.

SUMMARY OF THE INVENTION

The object of the present invention is to obtain a novel and unique sealing method and a seal or closure for plastic bottles, being especially suitable for such liquids which have a medical application and which are treated in the plastic bottle by heat treatment, such as sterilization in an autoclave, such as infusion solutions and rinsing liquids.

In accordance with the present invention said object is obtained while certain drawbacks of previously known technique are eliminated and some below indicated advantages are obtained. Said results are obtained by the features characterizing the invention according to the attached claims.

BRIEF DESCRIPTION OF THE DRAWING

Some presently preferred embodiments of the invention are illustrated on the attached drawings, wherein FIG. 1 in a perspective view illustrates a plastic bottle suitable to be sealed by the sealing method and the seal according to the invention, FIG. 2 in a sectional view illustrates the elements of an embodiment of the seal according to the invention.

DESCRIPTION OF THE PREFERRED EMBODIMENTS

Figure 1:
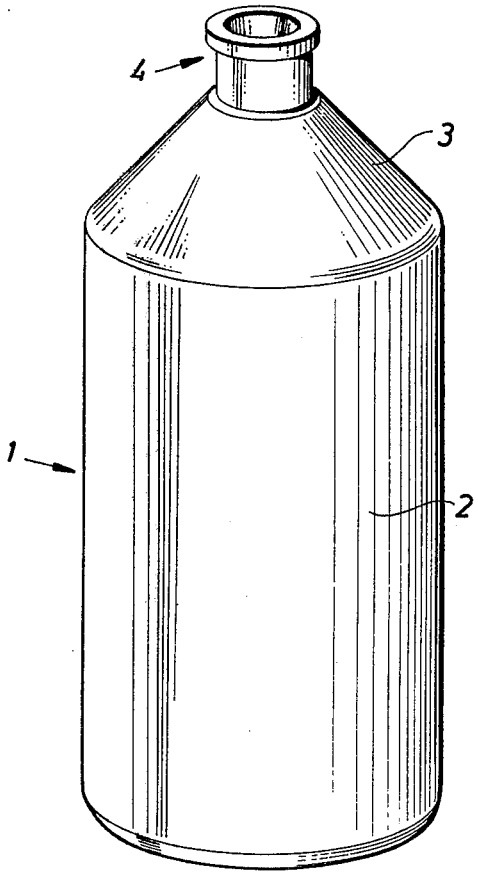

FIG. 1 illustrates a plastic bottle 1, upon the throat portion 4 of which a seal according to the invention may be applied. The plastic bottle 1 has a generally cylindrical body 2, a tapering transition portion 3 between the body 2 and the throat 4 as well as a bottom portion (not illustrated).

Figure 3:
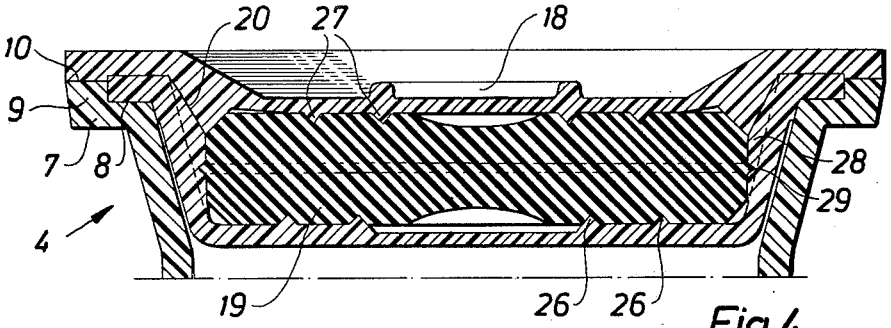
FIG. 3 illustrates the sealing elements of FIG. 2 after the sealing operation.
Figure 4:
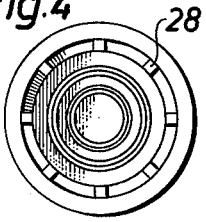
FIG. 4 illustrates an inner cap of the seal seen from above.

The plastic bottle illustrated in FIG. 1 has in the embodiment according to FIG. 3 the throat portion 4 thereof formed in a step like fashion with a first part 7 extending outwardly and a second part 9 extending upwardly in an angle relative to said first part. Said first part 7 has an upper annular contact surface 8 and the upwardly extending part 9 has an annular upper surface 10. In the embodiment according to FIG. 5 the outwardly directed flange portion 7 of the throat 4 is completely flat.

Figure 2:
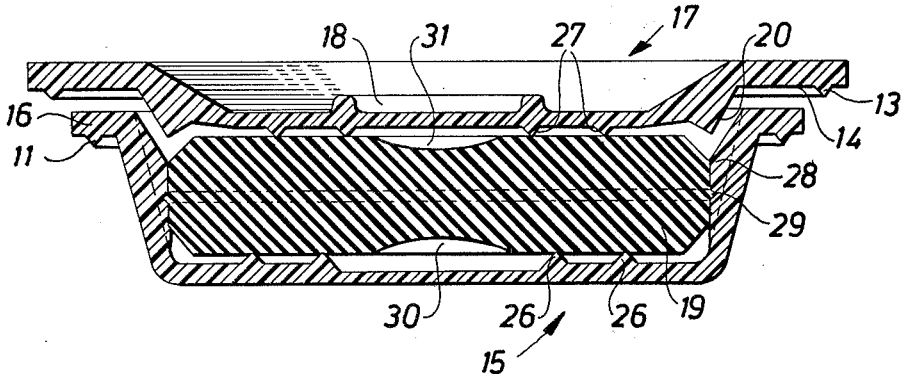

The seal according to the embodiment illustrated in FIGS. 2–3 comprises a somewhat conical, bowl-like inner cap 15 having an outwardly directed flange portion 16, as well as an outer cap 17 which may have a penetration portion 18 for receiving e.g. a cannula or an infusion unit. The outer cap 17 has a depending guide and contact flange 20 extending somewhat down into the inner cap 15 and guiding the outer cap 17 to its intended position. As is illustrated in FIG. 2, the flange portion 16 of the inner cap 15 is on its bottom surface provided with a continuous weld locating ring or bead 11 upon the bottom surface 12 of the flange 16 since, which below will be explained more in detail, the seal according to the invention is mounted by ultrasonic welding. A corresponding continuous weld locating ring 13 is provided on the outer portion of the outer cap 17 upon the bottom surface 14 thereof. Of course, the ring or bead 11 may be directed upwardly, if this is preferred, and for instance in the embodiment illustrated on FIG. 5 the weld locating ring 11 of the inner cap 15 (said ring or bead 11 cannot be seen in the assembled condition) is hence facing upwardly against the outer cap 17 since in such a case a complete seal unit may be pre-fabricated and then mounted to the bottle throat 4 by ultrasonic welding the outer cap 17 to the bottle throat.

In accordance with the invention the seal is secured to the bottle throat 4 by ultrasonic welding. The material rings or beads 11 and 13 are during the welding operations locating points for the welding, they form so called energy guides, and as can be seen from FIG. 3 and 5 the material rings 11 and 13 will melt under compression during the welding operation and the material of said rings 11 and 13 will flow out resulting in a sealed closure. An elastic disc 19 is provided between the inner cap 15 and the outer cap 17, the function of said disc being partly to mechanically stiffen the closure and partly to sealingly surround the cannula during the discharging operation so that no leakage will occur at the penetration place of the cannula through the closure. The elastic disc 19 may be so formed and sized that it has to be forced into place and thereby a reclosing action will be caused by the elasticity when the cannula is withdrawn. The disc 19 may be provided with a bead 29 surrounding the perimeter thereof and in the application position engage with ribs or ridges 28 provided on the inner surface of the inner cap in axial direction (as shown in FIGS. 2 and 3). Upon the bottom surface of the inner cap 15 beads 26 are provided, in one case (FIG. 2) being directed upwardly for engagement with the bottom surface of the disc 19 and in another case (FIG. 5) being directed downwardly as a reinforcement for avoiding cracking during the penetration. Beads 27 are provided on the inner surface of the outer cap 17 for engagement with the upper surface of the disc 19. As can be seen from FIGS. 2 and 3 the bottom surface of the inner cap 15 is preferably provided with a thinner portion in the center thereof below the disc 19. The central portion of the disc 19 could also be provided with recessed portions 30 and 31, respectively, in the bottom and upper surface thereof in order partly to facilitate the penetration of the disc by a cannula and partly for locating the cannula during the penetration. Alternatively, the disc 19 may be provided with upwardly and downwardly projecting annular center portions in order to give an increased guide effect and avoid propagation of cracks. The most important function of the ribs or ridges 28 is during the insertion of the disc 19 within the inner cap 15 since they partly retain the disc in place and partly admit passage for the air being present within the inner cap since such air must escape to some extent during insertion of the disc into the inner cap. By the illustrated arrangement a space is also obtained between the two caps wherein some air and moisture are present since some moisture always remains on the disc after the sterilization operation. By such trapped air and moisture a space is obtained which could be called a "steam chamber" and by the existence of said "steam chamber" sterility in said space is guaranteed in connection with autoclave operation.

Figure 5:
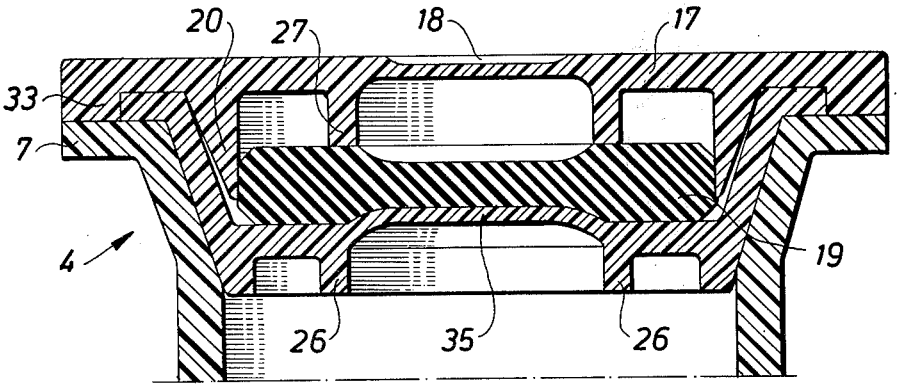
FIG. 5 illustrates another embodiment of the seal according to the invention.

FIG. 5 illustrates a modified embodiment of the seal illustrated in detail in FIGS. 2 and 3. The outer cap 17 is provided with a substantially flat upper surface except for the fact that the penetration portion 18 is provided in the form of a depression in the central part of the outer cap. The bottle throat 4 has a flat flange 7 and the outer portions of the outer cap 17 are turned downwardly into a downwardly directed flange 33. Reinforcing and penetration locating support portions are provided in the inner cap, the central portion 35 of which being somewhat domed upwardly in order to abut the elastic disc 19. The rest of the embodiment according to FIG. 5 is equivalent to that according to FIGS. 2 and 3 with the exception of above mentioned upward location of the weld locating ring 11. In this embodiment the closure unit is pre-fabricated by placing the elastic disc within the inner cap 15, whereupon the inner cap is welded to the outer cap. Then, the complete unit is welded to the bottle throat.

By the use of the inner cap 15 there is no risk of contact between the elastic disc 19 and the liquid and an inert surface will thereby always face the liquid. By the use of the elastic disc 19 a simple seal will be obtained for the cannula while a reclosing effect will be obtained upon withdrawal.

The plastic bottle 1 as well as the two caps 15 and 17 could be manufactured by a suitable resin material as for instance polypropylene.

The outer cap 17 in the embodiment according to FIGS. 2–5 could, if necessary, be provided with a not illustrated removable part in order to obtain a sterile penetration point for a cannula or the like.

Figure 6:
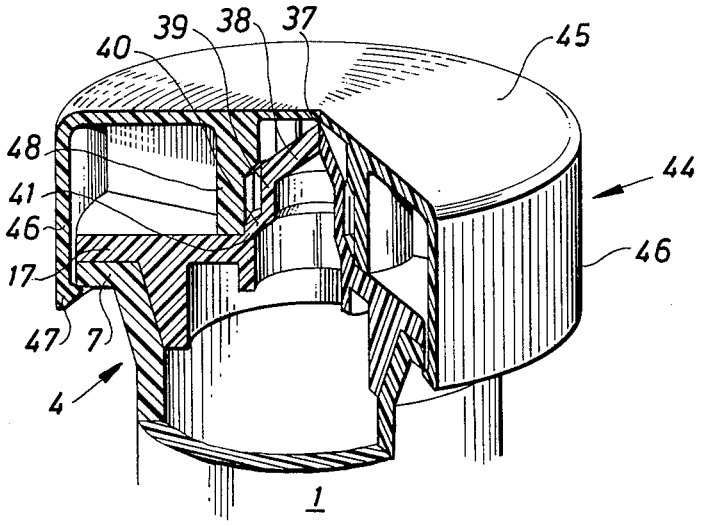
FIG. 6 illustrates an additional embodiment of the invention especially adapted for plastic bottles comprising rinsing liquid and wherein a novel and unique outer cover has been applied about the bottle seal, the specific configuration and function of said outer cover will be further explained below.
Figure 7:
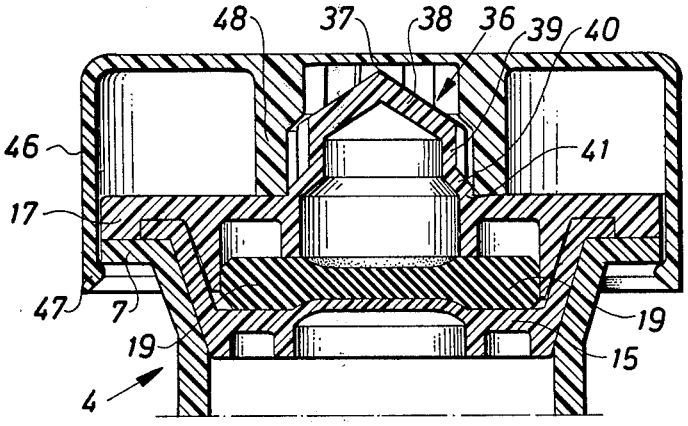
FIG. 7 illustrates an additional modified embodiment of the invention especially adapted for plastic bottles containing infusion liquid, wherein an outer cover similar to the one according to FIG. 6 also is provided.
Figure 9:
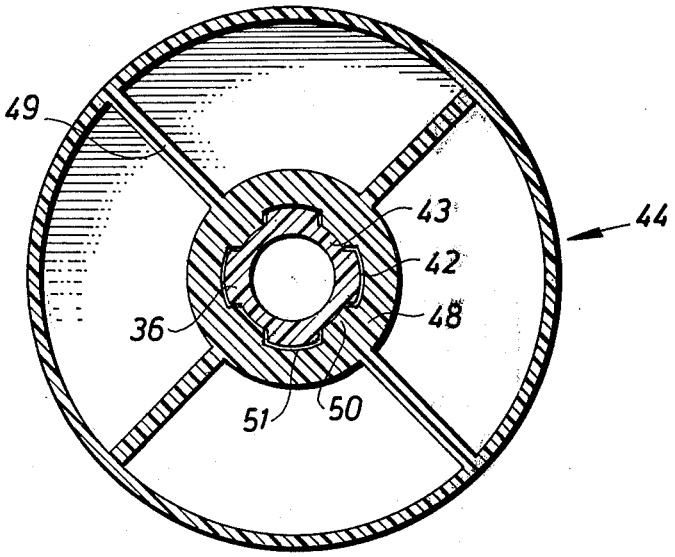

FIGS. 6 and 7 illustrate modified embodiments of the invention. The embodiment according to FIG. 6 is especially suitable for such plastic bottles which should contain a rinsing solution and the embodiment according to FIG. 7 is intended for infusion solution bottles. The bottle 1 has in that connection its throat portion 4 formed in a similar way as in connection with the embodiment according to FIG. 5 but in the embodiment according to FIG. 6 there is only an outer cap 17 but no inner cap and no elastic disc. In both said cases the outer cap 17 is modified regarding its center portion, where a projecting part 36 provided with a tip 37 is arranged. Downwardly sloping surfaces 38 extend from the tip 37 merging into a substantially cylindrical portion 39 being substantially parallel to the central line of the closure. The projecting part 36 then again extends in an inclined direction downwardly and outwardly in a portion 40 and then merges into the outer cap 17 in a somewhat weakened part 41 constituting a breakage spot. The substantially cylindrical intermediate part 39 is provided with projecting or recessed portions providing ridges 42 and splines 43, which can best be seen in FIG. 9. On top of the bottle throat 4 an outer cover 44 is provided, said outer cover having a substantially flat upper surface 45 and downwardly extending walls 46. Below the wall 46 a snap element 47 is preferably arranged for keeping the outer cover to the bottle neck.

The outer cover 44 is in addition to providing a shipping and dust protection also intended to constitute a tool for forming a hole in the cap 17. Said outer cover 44 has a central depending flange-like ring 48 which is connected to the outer wall 46 by reinforcement ribs 49 identified in FIG. 9. In said flange or ring 48 ridges 50 and splines 51 are provided, also best seen in FIG. 9 conforming to the splines 43 and ridges 42 respectively in the projecting tipped portion 36.

Figure 8:
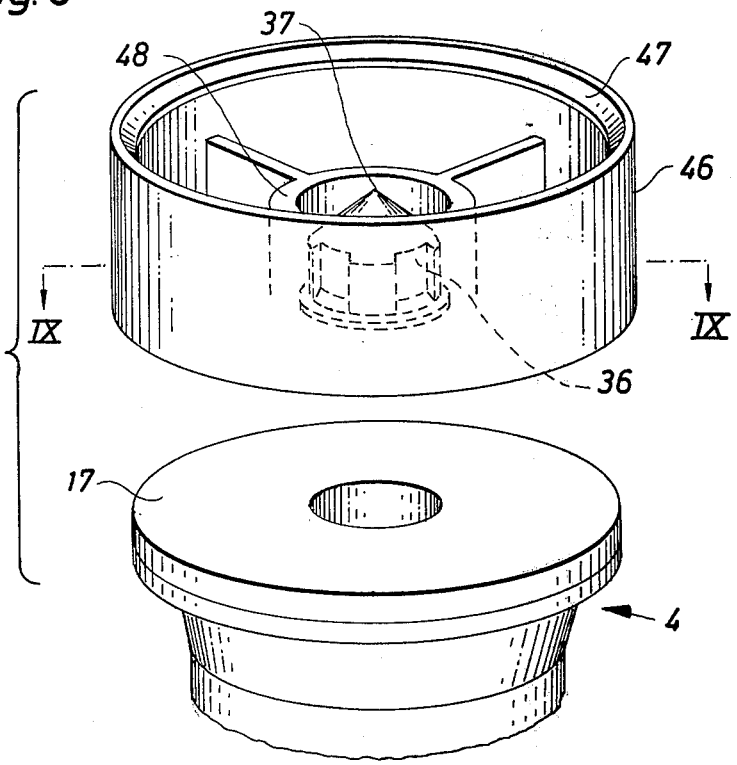
FIG. 8 illustrates in a perspective exploded view, wherein some underlying details are indicated by broken lines, how the outer cover has been used as a tool after having been turned upside-down for twisting off a twist-off tip and the outer cover has then been lifted upwardly so that the throat portion of the bottle is left with a hole as is illustrated on the lower portion of the figure, and FIG. 9, in a view seen from below, illustrates the outer cover according to FIG. 8 having the tip being twisted off maintained therein.

When the bottle according to FIG. 6 is to be used, the outer cover or hood 44 is removed by being pulled upwardly so that the snap element 47 springs outwardly and passes past the flange 7 of the bottle. Then the outer cover 44 is turned upside down and pressed against the tip 37. Said tip 37 will thereby penetrate the outer cover and during additional downward displacement of the cover 44 the splines 51 and ridges 50 thereof will mate with the ridges 42 and splines 43, respectively, of the projecting portion 36 so that a mutual engagement is obtained between the upside down turned cover and the projecting central part of the seal. Then the cover 44 is twisted and the projecting portion 36 will be twisted off at the breakage spot 41, and the outer cover may then be lifted upwardly as illustrated in FIG. 8 and the tipped center portion will by the engagement remain in the cover, as is illustrated in FIG. 8. Hereby a center hole is obtained in the cap 17. In connection with the embodiment according to FIG. 6, being especially intended for rinsing solution liquid, no inner cap and no elastic disc are necessary. In the embodiment according to FIG. 7 intended for infusion solution bottles the outer portion of the outer cap 17 is turned downwardly similar to the embodiment according to FIG. 5 but of course the same flat arrangement as that according to FIG. 6 could exist even in that connection for the outer cap 17. Inside the outer cap the elastic disc 19 and the inner cap 15 are provided.

When the upside down oriented cover 46 is depressed the upper surface 45 thereof is not able to move completely down to the upper surface of the upper cap 17 due to the contact with the outwardly sloping portion 40, and hereby the risk for contamination of the portion around the center hole by contacting a not sterilized portion of the cover 46 is eliminated. The cap 17 will hence also after that the portion 36 has been twisted-off have a non contaminated upper surface.

By using the sealing method according to the invention utilizing ultrasonic welding the following advantages are obtained in relation to previous attempts to seal plastic bottles by the aid of heat for melting together certain surfaces, namely that such troubles as for instance remaining water or product waste on the different surfaces will not disturb the welding operation but a completely sealed weld will be obtained even though the weld surfaces have not been completely cleaned. That was not possible in connection with for instance heat welding. By the use of ultrasonic welding the time of the welding operation may be shortened. Additionally, the seal according to the present invention admits an improved construction of the penetration surface for cannulas, for instance from the sanitary point of view.

A plastic bottle for instance of the type illustrated in FIG. 1 may be sealed in accordance with the invention in the following way. When the plastic bottle has been manufactured, cleaned and filled with the intended contents, such as infusion solution or rinsing solution liquid, a seal is applied onto the bottle neck and mounted by ultrasonic welding. In connection with infusion solution bottles, the seal comprises a sterilized inner cap 15 and the attaching sterilized disc 19, which together with the outer cap 17 suitably have been prefabricated as a complete unit. In connection with the ultrasonic welding, the seal is welded to the bottle neck and, when necessary, the plastic bottle with its contents may be treated by such treatment operations as for instance sterilization in autoclave with a guaranteed sealed closure. Alternatively, the mounting operation could take place in stages so that firstly the inner cap is welded to the bottle neck, then the elastic disc is inserted and finally the upper cap is applied and welded to the bottle neck.

Even though some illustrative embodiments of the invention above have been described and are also illustrated on the attached drawings, those skilled in the art realize that variations and modifications of the basic idea according to the invention may be made within the basic frame of the invention. Hence, the man within the art realizes that other modifications of the basic concept than those herein described and illustrated are covered by the invention being defined in the attached claims.

We claim:

1. A sealing unit for sealing a container by engaging the throat thereof, the unit being of a material which can be joined to the container by ultrasonic welding, said unit comprising a sealing member provided with an outer flange arranged to bear on, and to be ultrasonically welded to, the container throat to seal the container, said flange extending inwardly from the periphery of said member, said member further including an upwardly projecting pointed portion in the central region of said flange and a connecting portion connecting said upwardly projecting portion to said flange, said connecting portion having a low resistance to breakage for permitting said upwardly projecting portion to be broken off from said flange to provide an opening in said sealing member further comprising an inner cap and an elastic disc arranged between said inner cap and said sealing member provided with said flange.

2. A sealing unit for sealing a container by engaging the throat thereof, the unit being of a material which can be joined to a container by ultrasonic welding, said unit comprising: first and second caps of plastic material; and a disc of elastic material interposed between said caps; each said cap being provided with an annular weld locating protrusion for permitting said first cap to be ultrasonically welded to the container throat and said second cap to be ultrasonically welded to one of the container throat and said first cap, whereby the unit is adapted to seal the container with said first cap constituting an outer cap and said second cap constituting an inner cap interposed between said first cap and the interior of the container; and wherein said inner cap comprises a conical bowl-like portion and said outer cap is provided with a depending guiding and supporting flange extending into said conical bowl-like portion of said inner cap.

3. A seal according to claim 2, wherein said outer cap is provided with rings extending toward, and adapted to contact, said disc when said unit seals such container.

4. A seal according to claim 3, wherein said disc is provided with a bead around its periphery and said inner cap is provided with a plurality of axially extending extensions engaging said bead extending around said disc.

5. A sealing unit for sealing a container by engaging the throat thereof, the unit being of a material which can be joined to the container by ultrasonic welding, said unit comprising a sealing member provided with an outer flange arranged to bear on, and to be ultrasonically welded to, the container throat to seal the container, said flange extending inwardly from the periphery of said member, said member further including an upwardly projecting pointed portion in the central region of said flange and a connecting portion connecting said upwardly projecting portion to said flange, said connecting portion having a low resistance to breakage for permitting said upwardly projecting portion to be broken off from said flange to provide an opening in said sealing member, said upwardly projecting portion being provided with ridges and splines, and said unit further comprising an outer cover arranged to be disposed around the throat portion of the container and around said sealing member, said outer cover being internally provided with means complementary to said ridges and splines and capable of being pushed, with said cover in an upside down position, over said upwardly projecting portion to engage therewith in order to twist off said upwardly projecting portion at said connecting portion, said outer cover in addition to being a dust and shipping protection thus also constituting a removal tool for removing said upwardly projecting portion.

6. In combination: a container of plastic material having a throat; and a sealing unit comprising a sealing member provided with an outer flange bearing on, and ultrasonically welded to, said throat to seal the interior of said container, said flange extending inwardly from the periphery of said member, said member further including an upwardly projecting pointed portion in the central region of said flange and a connecting portion connecting said upwardly projecting portion to said flange, said connecting portion having a low resistance to breakage for permitting said upwardly projecting portion to be broken off from said flange to provide an opening in said sealing member.

7. A sealing unit for sealing a container by engaging the throat thereof, the sealing unit comprising a sealing member provided with a flange extending inwardly from the periphery of said member and including an upwardly projecting pointed portion and a connecting portion having a low resistance to breakage and connecting said upwardly projecting portion to said flange, said upwardly projecting portion being provided with ridges and splines, and said unit further comprising an outer cover arranged to be disposed around the throat portion of the container and around said sealing member, said outer cover being internally provided with means complementary to said ridges and splines and capable of being pushed, with said cover in an upside down position, over said upwardly projecting portion to engage therewith in order to twist off said upwardly projecting portion at said connecting portion, said outer cover in addition to being a dust and shipping protection thus also constituting a removal tool for removing said upwardly projecting portion.

* * * * *